United States Patent [19]

Watanabe

[11] Patent Number: 4,826,614

[45] Date of Patent: May 2, 1989

[54] LUBRICATION BOOSTING ADDITIVES AND LUBRICATING OIL COMPOSITIONS COMPRISING THE SAME

[75] Inventor: Ryoji Watanabe, Osaka, Japan

[73] Assignees: Violet Co., Ltd.; Wako Technical Co., Ltd., both of, Japan

[21] Appl. No.: 920,332

[22] Filed: Oct. 17, 1986

[30] Foreign Application Priority Data

Oct. 21, 1985 [JP] Japan ..... 60-234737

[51] Int. Cl.[4] ..... C10M 115/04; C10M 115/06

[52] U.S. Cl. ..... 252/54; 252/52 R; 252/56 R; 252/58

[58] Field of Search ..... 252/18, 25, 149.9, 54, 252/58; 44/62, 70

[56] References Cited

U.S. PATENT DOCUMENTS

| | | | |
|---|---|---|---|
| 3,159,609 | 12/1964 | Harris | 252/54 |
| 3,575,857 | 4/1971 | Grover | 252/58 |
| 3,793,197 | 2/1974 | Chapman | 252/54 |
| 4,039,301 | 8/1977 | Laity | 44/62 |
| 4,615,917 | 10/1986 | Runge | 252/58 |

FOREIGN PATENT DOCUMENTS

| | | | |
|---|---|---|---|
| 0825593 | 4/1981 | U.S.S.R. | 252/58 |
| 0497782 | 12/1938 | United Kingdom | 252/58 |

OTHER PUBLICATIONS

*The Merck Index,* 9th Edition (1976), p. 537, entry 4040.

*Primary Examiner*—William R. Dixon, Jr.
*Assistant Examiner*—Margaret B. Medley
*Attorney, Agent, or Firm*—Lowe, Price, Leblanc, Becker & Shur

[57] ABSTRACT

A lubrication boosting additive comprising a mixture of a fluororesin, which is an alternating copolymer of a fluoroolefin and vinyl ether, soluble in an organic solvent and a phthalic ester in an organic solvent. The amounts of the organic solvent and the phthalic acid are, respectively, from 50 to 500 parts by weight and from 1 to 50 parts by weight per 100 parts by weight of the fluororesin. The additive is added to lubricating oils in an amount of from 0.1 to 10 g, calculated as the fluororesin, per liter of the lubricating oil.

17 Claims, No Drawings

LUBRICATION BOOSTING ADDITIVES AND LUBRICATING OIL COMPOSITIONS COMPRISING THE SAME

BACKGROUND OF THE INVENTION

1. Field of the Invention

This invention relates to additives for improving lubricating characteristics of lubricating oils and more particularly, to lubrication boosting additives which, when added to lubricating oils for use in power engines, can improve load bearing properties of the oils and can prevent wear of the power engines while mitigating the lowering of an energy efficiency owing to the friction. The invention also relates to a lubricating oil composition comprising the lubricating boosting additive mentioned above.

2. Description of the Prior Art

As is known in the art, lubrication boosting additives have been used in order to improve lubricating characteristics of lubricating oils. Typical examples of the commercially sold additives include suspensions of polytetrafluoroethylene (PTFE) and molybdenum disulfide in the form of fine powder.

PTFE is a resin which has good lubricating characteristics and a high chemical resistance, but is inconveniently insoluble in almost all the types of solvents, thus making it impossible to use PTFE as a solution. This is why PTFE is used in the form of a fine powder in a suspension in practical applications. However, the use of the suspension involves a serious problem with respect to its compatibility with or dispersability in lubricating oils. For instance, the fine powder may settle in the suspension prior to use or after mixing with lubricating oils. Alternatively, the fine powder may deposit on power engines or may clog filters therewith.

Moreover, the fine powder of PTFE or molybdenum disulfide does rarely contributes to the improvement of the load bearing properties when added to lubricating oils.

SUMMARY OF THE INVENTION

It is accordingly an object of the invention to provide a lubrication boosting additive which is added to lubricating oils as a solution and which can overcome the drawbacks involved in prior art additives added in the form of a suspension.

It is another object of the invention to provide a lubrication boosting additive which can impart improved load bearing properties and an improved wear resistance to lubricating oils.

It is a further object of the invention to provide a lubrication boosting additive which can increase a power output and can suppress noises of engine systems, such as internal combustion engines, when applied to lubricating oils for use in the engine systems.

It is a still further object of the invention to provide a lubrication boosting additive which can reduce a fuel cost and can prolong the life of parts on application to lubricating oils for use in internal combustion engines of motor vehicles.

It is another object of the invention to provide a lubricating oil composition which comprises a specific type of oil boosting additive.

The lubrication boosting additive of the invention comprises a mixture of a fluororesin dissolved in an organic solvent and a phthalic ester. The solvent and the phthalic ester are, respectively, used in amounts of from 50 to 500 parts by weight and from 1 to 50 parts by weight per 100 parts by weight of the fluororesin. The fluororesin may be any of the fluororesins which are soluble in organic solvents. Specific fluororesins useful in the present invention are alternating copolymers of fluoroolefins and vinyl ethers. Preferably, the fluororesins should have a fluorine content of about 25 to 30 wt%. The phthalic ester does not necessarily dissolve in the solvent. The lubricating oil composition should comprise from 0.01 to 10 g of the above lubrication boosting additive, calculated as the fluororesin, per liter of a lubricating oil used.

DETAILED DESCRIPTION AND EMBODIMENTS OF THE INVENTION

The fluororesins which are used in the practice of the invention should be soluble in organic solvents. Specific examples of the soluble fluororesins include alternating copolymers of fluoroolefins and vinyl ethers.

The fluoroolefins may be represented by the formula, $CF_2CFX$, in which X represents a halogen. Specific examples of the fluoroolefins include trifluoromonochloroethylene, trifluoromonobromoethylene, and the like.

The vinyl ether may be represented by the formula, $CH_2CHOR$, in which R represents an alkyl group, a cycloalkyl group, a hydroxyalkyl group or a carboxyalkyl group. The alkyl group has generally from 1 to 6 carbon atoms and includes, for example, methyl, ethyl, propyl, butyl and the like. The cycloalkyl has generally 5 to 6 carbon atoms and includes, for example, cyclopentyl and cyclohexyl. Similarly, the hydroxyalkyl group has generally from 1 to 6 carbon atoms, and the carboxyalkyl group has from 1 to 6 carbon atoms.

As is known in the art, vinyl ethers are cation-polymerizable monomers and are not necessarily polymerized by radical polymerization. On the other hand, fluoroolefins are known to readily give copolymers with vinyl ethers because of the electrophilic properties of the fluoroolefins. The copolymerization of the fluoroolefins and vinyl ethers may be carried out by known polymerization processes including bulk, solution and emulsion polymerization techniques using known polymerization conditions. Accordingly, specific polymerization processes for these copolymers are not described herein. The copolymers have high reactivity and should preferably have a molecular weight of from $5\times10^3$ to $2\times10^5$ in the practice of the invention.

The copolymers may further comprise carboxyl groups therein. For the introduction of carboxyl groups into the copolymer, it is difficult to utilize the copolymerization reaction because the vinyl ether is unstable in an oxidative atmosphere. Accordingly, the reactivity of the OR groups in the vinyl ether units is utilized. More particularly, the resin obtained after the copolymerization between the fluoroolefin and the vinyl ether is subjected to reaction with carboxylic acids, thereby introducing carboxyl groups in the copolymer. If the carboxyl groups are added, the content of the carboxyl groups is from 0.01 to 10 parts by weight per 100 parts by weight of the copolymer. The introduction of the carboxyl groups is effective because of their reactivity with the remaining OR groups in the copolymer and/or a curing agents such as melamine.

The copolymers of fluoroolefins and vinyl ethers with or without carboxyl groups are commercially sold, for example, as Lumiflon series from Asahi Glass Co., Ltd. as will be particularly described in the example.

The solvents for these copolymers may be ketones, esters, halogenated hydrocarbons, aromatic hydrocarbons and the like. Specific and preferable examples of the solvents include acetone, methyl ethyl ketone, methyl isobutyl ketone, cyclohexanone, ethyl acetate, butyl acetate, ethoxydiethyl acetate, diethylene glycol, monoethyl ether, ethylene glycol monobutyl ether, $$\left[C_2H_4OC_2H_4O\right], \left[C_2H_4O\right],$$

trichloroethane, chloroform, benzene, xylene, toluene and mixtures thereof. Of these, methyl isobutyl ketone, xylene, ethylene glycol monobutyl ether and mixtures thereof are preferred.

The phthalic esters serve to improve wear resistance which may slightly lower by the addition of the soluble fluororesins. Examples of the phthalic esters include dibutyl phthalate, dioctyl phthalate, diisodecyl phthalate and the like. Of these, dibutyl phthalate and dioctyl phthalate are preferred.

The amounts of the respective ingredients including the solvent for the fluororesin may vary depending on the types of lubricating oil, fluororesin, solvent and phthalic ester. In general, the solvent is used in an amount of from 50 to 500 parts by weight (hereinafter referred to simply as parts), preferably from 150 to 300 parts, and the phthalic acid is used in an amount of from 1 to 50 parts, preferably from 1 to 10 parts, each per 100 parts of the fluororesin. The lubrication boosting additive of the invention is in the form of a solution but may contain a small amount of insoluble matters. When the amount of the phthalic ester increases, compatibility with a soluble fluororesin and a lubricating oil lowers to a slight extent. This leads to a tendency toward a lowering in degree of improvement of the load bearing properties of lubricating oils owing to the soluble fluororesins.

Preferable lubrication boosting additives of the invention should comprise, in combination, 100 parts of a soluble fluororesin, from 30 to 300 parts, preferably from 100 to 200 parts, of xylene, 10 to 200 parts, preferably 30 to 100 parts, of ethylene glycol monobutyl ether, and from 1 to 50 parts, preferably from 1 to 10 parts, of dioctyl phthalate.

The lubricating oils adapted for use with the lubrication boosting additive of the invention may be any lubricating oils which are ordinarily used in engine systems such as reciprocating engines, turbo-propeller engines, rotary engines and the like and also in movable parts such as bearings. The lubrication boosting additive is added to lubricating oils in amounts of from 0.01 to 10 g, preferably from 0.1 to 4 g, per liter of the lubricating oil on calculation as the soluble fluororesin.

In practical applications, it is preferred that the additive of the invention is pre-mixed with a small amount of a lubricating oil. This permits the additive to be more readily mixed with or dispersed in a lubricating oil. To this end, a lubricating oil is preferably added to the boosting additive in an amount of from 10 to 30 parts per 100 parts of the fluororesin.

The present invention is more particularly described by way of example, which should not be construed as limiting the present invention.

EXAMPLE

A soluble fluororesin (Lumiflon LF-400, available from Asahi Glass Co., Ltd.) was mixed with xylene, ethylene glycol monobutyl ether (EGBE) and/or dioctyl phthalate at mixing ratios indicated in Table below, thereby obtaining lubrication boosting additives. These additives were each added to one liter of a lubricating oil (engine oil for automobiles, available from Idemitsu Kosan Co., Ltd.) in amounts, calculated as the fluororesin, indicated in the table. The resulting lubricating oil compositions were subjected to measurements of a load bearing property and a wear resistance. These properties were determined by the Soda four ball friction tester and expressed in terms of a load bearing capacity and a diameter of a wear defect.

TABLE

| Test No. | Additive Composition (parts by weight) fluoro-resin | xylene | EGBE | DOP | Amount of Fluororesin in one liter of Lubricating Oil (g) | Lubricating Characteristics load bearing capacity ($kg/cm^2$) | wear resistance (mm) |
|---|---|---|---|---|---|---|---|
| 1 | — | — | — | — | — | 7.0 | 0.55 × 0.53 |
| 2 | 100 | 125 | 75 | 2.5 | 0.4 | 10.5 | 0.60 × 0.59 |
| 3 | 100 | 125 | 63 | 6.3 | 1.6 | 9.5 | 0.58 × 0.58 |
| 4 | 100 | 125 | 63 | 6.3 | 8.0 | 8.0 | 0.59 × 0.58 |
| 5 | 100 | 125 | 50 | — | 2.0 | 9.0 | 0.89 × 0.87 |
| 6 | 100 | 125 | 25 | — | 4.0 | 9.0 | 0.79 × 0.92 |
| 7 | 100 | 125 | 50 | — | 8.0 | 8.0 | 0.84 × 0.79 |

As will be seen from the above results, when DOP is not used (test Nos. 5–7), the load bearing capacity is improved with a lowering of the wear resistance. However, when DOP is added (test Nos. 2–4), the load bearing capacity is improved with a good wear resistance. Thus, when soluble fluororesins are used in combination with phthalic esters, the lubricating characteristics are significantly improved over those of the lubricating oil with or without the soluble fluororesin.

All the additives were found not to cause phase separation or gelation of the fluororesin 3 days after the preparation and could be readily and uniformly mixed with the lubricating oil.

What is claimed is:

1. A lubrication boosting additive comprising 100 parts by weight of a fluororesin which consists essentially of an alternating copolymer of a fluoroolefin and a vinyl ether and which is soluble in an organic solvent, from 50 to 500 parts by weight of an organic solvent for said fluororesin, and from 1 to 50 parts by weight of a phthalic ester.

2. A lubrication boosting additive according to claim 1, wherein said solvent is a member selected from the group consisting of ketones, esters, ethers, halogenated hydrocarbons, aromatic hydrocarbons and mixtures thereof.

3. A lubrication boosting additive according to claim 2, wherein said solvent is xylene.

4. A lubrication boosting additive according to claim 2, wherein said solvent is ethylene glycol monobutyl ether.

5. A lubrication boosting additive according to claim 1, wherein said phthalic ester is dioctyl phthalate or dibutyl phthalate.

6. A lubrication boosting additive according to claim 1, wherein said fluororesin has carboxyl groups introduced in an amount of from 0.01 to 10 parts by weight per 100 parts by weight of said copolymer.

7. A lubrication boosting additive according to claim 1, wherein said fluoroolefin is represented by the formula, $CF_2CFX$, in which X represents a halogen and said vinyl ether is represented by the formula, $CH_2CHOR$, in which R represents an alkyl group, a cycloalkyl group, a hydroxyalkyl group or a carboxyalkyl group.

8. A lubrication boosting additive according to claim 1, wherein the content of fluorine atoms in the resin is in the range of from 25 to 30 wt%.

9. A lubrication boosting additive comprising 100 parts by weight of a fluororesin which consists essentially of an alternating copolymer of a fluoroolefin and a vinyl ether and which is soluble in an organic solvent, from 30 to 300 parts by weight of xylene, from 10 to 200 parts by weight of ethylene glycol monobutyl ether, and from 1 to 50 parts by weight of dioctyl phthalate.

10. A lubricating oil composition which comprises a lubricating oil and a lubrication boosting additive comprising a mixture of 100 parts by weight of a fluororesin, which consist essentially of an alternating copolymer of a fluoroolefin and a vinyl ether, dissolved in from 50 to 500 parts by weight of an organic solvent and from 1 to 50 parts by weight of a phthalic ester, said lubrication boosting additive being used in an amount of from 0.01 to 10 g, calculated as the fluororesin, per liter of the lubricating oil.

11. A lubricating oil composition according to claim 10, wherein said solvent is xylene or ethylene glycol monobutyl ether.

12. A lubricating oil composition according to claim 10, wherein said phthalic ester is dioctyl phthalate or dibutyl phthalate.

13. A lubricating oil composition according to claim 10, wherein said fluororesin has carboxyl groups introduced in an amount of from 0.01 to 10 parts by weight per 100 parts by weight of the copolymer.

14. A lubricating oil composition according to claim 13, wherein said fluoroolefin is represented by the formula, $CF_2CFX$, in which X represents a halogen, and said vinyl ether is represented by the formula, $CH_2CHOR$, in which R represents an alkyl group, a cycloalkyl group, a hydroxyalkyl group or a carboxyalkyl group.

15. A lubricating oil composition according to claim 13, wherein the content of fluorine atoms in the resin is in the range of from 25 to 30 wt%.

16. A lubrication boosting additive according to claim 1, wherein said alternating copolymer has a molecular weight of from $5\times10^3$ to $2\times10^5$.

17. A lubricating oil composition comprising a lubricating oil and a lubrication boosting additive comprising 100 parts by weight of a fluororesin which consists essentially of an alternating copolymer of of a fluoroolefin and a vinyl ether and which is soluble in an organic solvent, from from 10 to 200 parts by weight of ethylene glycol monobutyl ether and from 1 to 50 parts by weight of a phthalic ester, said lubrication boosting additive being used in an amount of from 0.01 to 10 g, calculated as the fluororesin, per liter of the lubricating oil.

* * * * *